US006726171B2

(12) United States Patent
Lopes

(10) Patent No.: US 6,726,171 B2
(45) Date of Patent: Apr. 27, 2004

(54) ICE MOLD

(75) Inventor: Luiz Antonio Diemar Lopes, Joinville - SC (BR)

(73) Assignee: Multibras S.A. Eletrodomesticos, Sao Paulo (BR)

( * ) Notice: Subject to any disclaimer, the term of this patent is extended or adjusted under 35 U.S.C. 154(b) by 0 days.

(21) Appl. No.: 10/181,845

(22) PCT Filed: May 22, 2001

(86) PCT No.: PCT/BR01/00064

§ 371 (c)(1),
(2), (4) Date: Nov. 19, 2002

(87) PCT Pub. No.: WO01/92795

PCT Pub. Date: Dec. 6, 2001

(65) Prior Publication Data

US 2003/0141431 A1 Jul. 31, 2003

(30) Foreign Application Priority Data

May 30, 2000 (BR) ..... PI 0003895

(51) Int. Cl.[7] ..... F25C 1/24
(52) U.S. Cl. ..... 249/111; 249/119

(58) Field of Search ..... 249/111, 119, 249/127, 133

(56) References Cited

U.S. PATENT DOCUMENTS 2,415,451 A 2/1947 Synnestvedt ..... 62/108.5
5,364,063 A * 11/1994 Nishimura et al. ..... 249/119

FOREIGN PATENT DOCUMENTS

FR 2 619 896 3/1989 ..... F25C/1/10
JP 02 029573 1/1990 ..... F25C/1/24

* cited by examiner

*Primary Examiner*—James P. Mackey
(74) *Attorney, Agent, or Firm*—Darby & Darby

(57) ABSTRACT

An ice mold of the type comprising a tray (10) incorporating a plurality of cavities (11) for ice formation, each two adjacent cavities (11) being separated by a corresponding tray portion (12), at least part of said tray portions (12) being provided with a window (20), which is dimensioned in order to allow the formation and the ascending passage of a convective air current between each two adjacent cavities (11), at least part of the opposite lateral walls **(13*a*) of each cavity (11) being formed by double walls, which are laterally spaced from each other and define a receptacle (30)** that will be filled up with water to be frozen and solidified.

7 Claims, 2 Drawing Sheets

13b
10
13b
14
14a
14a 13
10
14

11
15
13a
13b
30
35
12
35
30
30
14a
14
14a
11

13
20
13a
14

ICE MOLD

FIELD OF THE INVENTION

The present invention refers to an ice mold construction of the type provided with a plurality of cavities for the formation of ice cubes and which is obtained in a single piece of plastic material.

BACKGROUND OF THE INVENTION

The molds for producing ice cubes to be used in refrigerators and freezers usually have longitudinal and/or transversal rows of cavities or receptacles for the formation of ice cubes, said cavities being dimensioned so that each may produce an ice cube having determined characteristics of shape and dimensions within a known pattern, conventionally searched by the user.

An ice mold construction known in the art is made of a metallic material, usually aluminum. This construction has some advantages, such as the quick formation of ice, due to the high speed of heat exchange between the mold material, which is a good heat conductor, and the environment where said mold is placed, usually a portion of the evaporating plate of a freezing compartment.

However, the constructions using a mold in a metallic material have some disadvantages, such as the lower surface of the mold cavities being easily adhered to the adjacent surface of the evaporating plate, difficulty in dislodging the formed ice cubes from the molds, rigidity of the piece, and cost of the product. In order to solve these problems, molds of plastic material have been developed. However, these constructions have some deficiencies, such as the low speed in which the ice cubes are formed, due to the reduced thermal conductibility of the plastic.

DISCLOSURE OF THE INVENTION

Thus, it is an object of the present invention to provide an ice mold obtained in a single piece and which allows a higher speed of ice cube formation.

This and other objectives are achieved by an ice mold of the type comprising, in a single piece, a tray incorporating at the lower part thereof a plurality of cavities for ice formation, which are superiorly open and have lateral walls and a bottom wall, and which are spaced from each other by a respective tray portion.

According to the present invention, each cavity has, at least in part of its lateral walls, a double wall forming a respective receptacle, which is inferiorly and laterally closed and superiorly open, and which will be filled up with water to be frozen and solidified, each receptacle incorporating at least one anchoring means for retaining the ice formed therein, even when the ice cubes formed in the cavities are removed.

BRIEF DESCRIPTION OF THE DRAWINGS

The invention will be described with reference to the attached drawings, in which.

BEST MODE OF CARRYING OUT THE INVENTION

Figure 1:
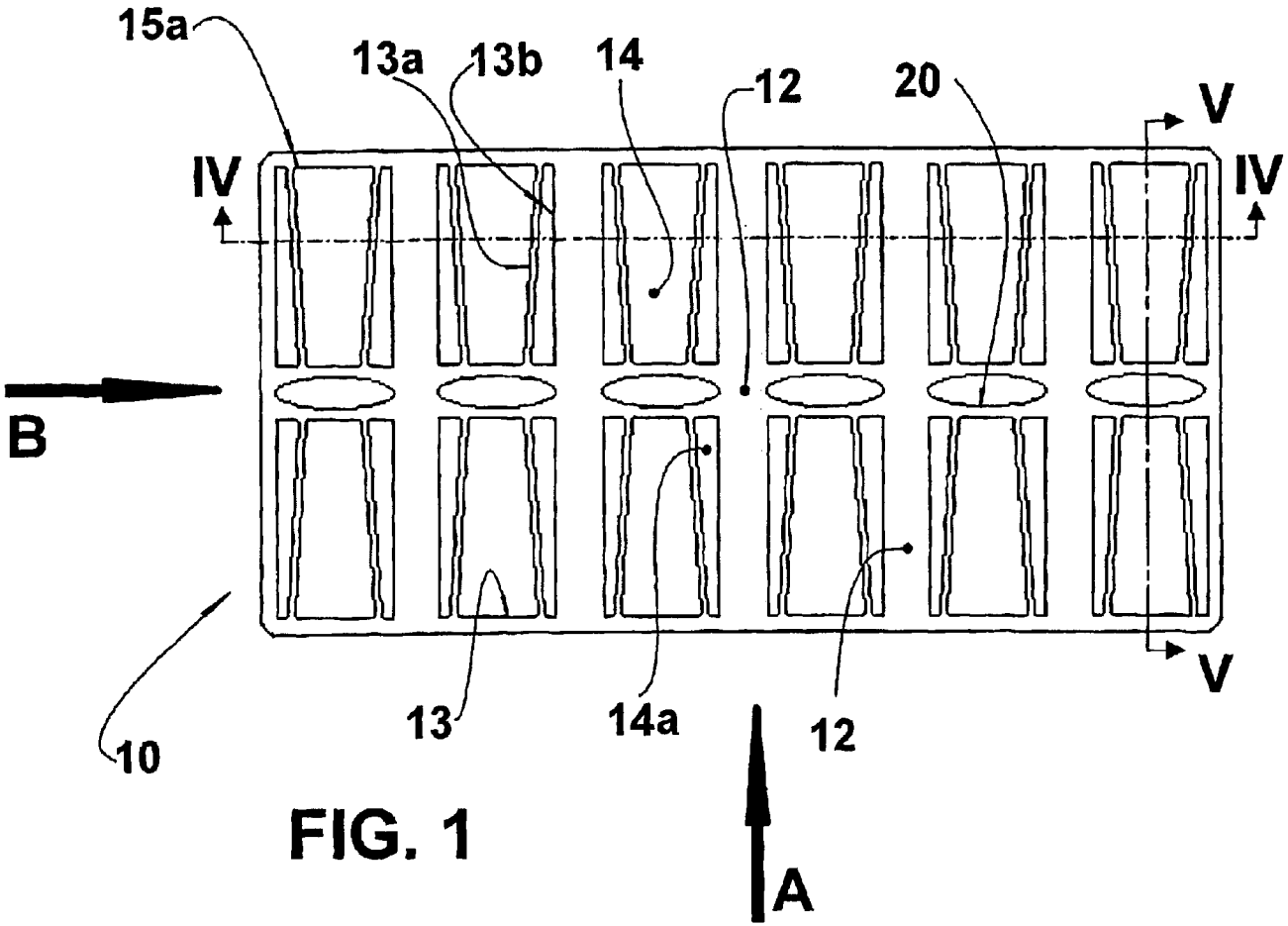
FIG. 1 illustrates, schematically, an upper plan view of the ice mold of the present invention.
Figures 2, 3, 4, 5:
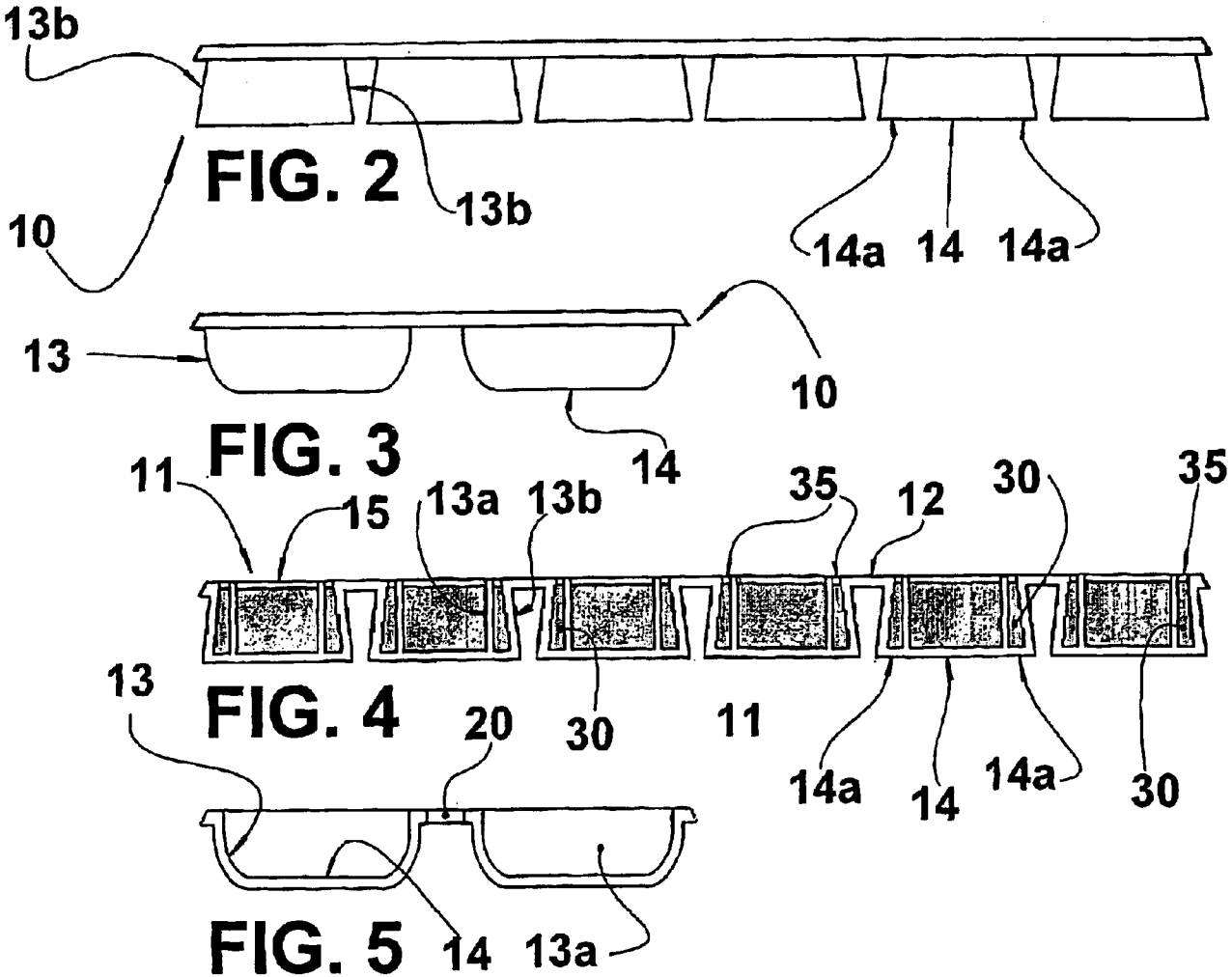
FIG. 2 illustrates, schematically, a lateral view of the ice mold of the present invention, said view being taken according to arrow "A" in FIG. 1.
FIG. 3 illustrates, schematically, a lateral view of the ice mold of the present invention, said view being taken according to arrow "B" in FIG. 1.
FIG. 4 illustrates, schematically, a cross-sectional view of the ice mold of the present invention, said view being taken according to line IV—IV in FIG. 1.
FIG. 5 illustrates, schematically, a longitudinal sectional view of the ice mold of the present invention, said view being taken according to line V—V in FIG. 1.

According to the present invention, the ice mold, which is preferably obtained in a single piece of plastic material, comprises a substantially flat tray 10 incorporating a plurality of adjacent cavities 11, which are spaced from each other by a corresponding tray portion 12, said cavities 11 being, for example, arranged in longitudinal and transversal rows in the tray 10, as illustrated.

Each cavity 11 is formed by two first opposite lateral walls 13 and by other two second opposite lateral walls 13*a*, converging to a lower bottom wall 14, to be seated on a surface for heat exchange and ice formation; and an open upper face 15, for extracting the ice formed inside each cavity 11.

According to the illustrated embodiment, at least part of the tray portions 12 defined between the two longitudinal alignments of the cavities 11 is provided with a window 20, which is dimensioned in order to allow the formation and the ascending passage of a convective air current between each two adjacent cavities 11 in this median region of the tray.

Each cavity 11 presents: an upper edge 15*a* of trapezoidal contour; a cross section, which is orthogonal to said bases of the trapezoidal contour 15*a*, defining a profile in which its two opposite lateral walls 13 are markedly arcuated and match with the bottom wall 14; and a cross section, which is parallel to said bases, where the second opposite lateral walls 13*a* of each cavity 11 define, together with the bottom wall 14, an inverted trapezoidal profile, in which the smaller base is defined by said bottom wall 14. Thus, each cavity has a preferably substantially inverted frusto-pyramidal shape.

Each of said second opposite lateral walls 13*a* is further formed, at least partially, as shown in the preferred embodiment, with a double wall defined by an additional external wall 13*b*, which has a certain spacing in relation to the adjacent second opposite lateral wall 13*a*, in order to define a receptacle 30, which is inferiorly and laterally closed and superiorly open, for receiving and containing a determined volume of water to be frozen and posteriorly solidified, in order to form an ice wall simultaneously with the formation of the conventional ice cubes in the respective cavities 11 of the tray 10. The bottom wall 14*a* of each receptacle 30 is preferably defined by a respective coplanar lateral projection of the bottom wall 14 of the respective cavity 11.

The extraction of the ice cubes formed in the cavities 11 is individually obtained, by pressing said ice cubes close to the smaller base of the trapezoidal contour 15*a* of the upper edge of the cavity 11, so as to cause the displacement of each ice cube, making it slide along the arcuated profile of the cavity in its cross section orthogonal to said bases.

The ice cubes formed inside each receptacle 30 are retained therein through a retaining and anchoring means incorporated in the receptacle itself. Said anchoring means may be formed, for example, by at least one superficial discontinuity (accident) provided in the inner face of the lateral walls and of the bottom wall of said receptacle 30 or, simply by reducing the contour of the upper opening 35 of the receptacle 30 in relation to the contour of the bottom wall 14*a* thereof.

According to the main aspect of the present invention and to a preferred illustrated embodiment, said dimensional reduction, for anchoring and retaining the ice walls, is achieved by a slight inclination of the additional external walls 13*b* of the double walls of each cavity 11, so that each additional external wall 13*b* has its upper end close to and its lower end spaced from the corresponding upper and lower ends, respectively of the adjacent second opposite wall 13*a* of each double wall of said cavity 11.

With the construction described above, the ice walls, which are formed and retained inside each receptacle 30, function as thermal conducting means that enhance the heat exchange between the internal environment of the freezing compartment and the mass of water to be frozen and solidified inside the respective cavities 11.

In order to maximize the effect cited above, the dimensioning of the receptacles 30 is designed in order to guarantee the maintenance of the frozen solid state of the respective volume of water during the operations of extracting the ice cubes and freezing new loads of water deposited in the cavities 11.

The higher thermal exchange through the at least partially double lateral walls of the cavities 11, associated with more air circulating through the windows 20, accelerates the production of ice cubes.

It should be further observed that the first opposite lateral walls 13 may also be partially or totally double and that the ice molds may present shapes other than those illustrated in the appended drawings.

What is claimed is:

1. An ice mold of the type comprising, in a single piece, a tray (10) incorporating at the lower part thereof a plurality of cavities (11) for ice formation, which are superiorly open and have first and second opposite lateral walls (13, 13*a*) and a bottom wall (14), and which are spaced from each other by a respective tray portion (12), characterized in that each cavity (11) has, at least in part of its first and second opposite lateral walls (13, 13*a*), a double wall forming a respective receptacle (30), which is inferiorly and laterally closed and superiorly open, and which will be filled up with water to be frozen and solidified, each receptacle (30) incorporating at least one anchoring means (35) for retaining the ice formed therein, even when the ice cubes formed in the cavities (11) are removed.

2. Ice mold, as in claim 1, characterized in that each cavity (11) has its bottom wall (14) defined by a flat surface, to be seated on the surface onto which the ice mold is placed, and an open upper face (15) with a contour that is larger than but substantially close to that of the bottom wall (14), in order to impart to the respective cavity (11) a substantially inverted frusto-pyramidal shape.

3. Ice mold, as in claim 1, characterized in that each receptacle (30) is formed by the provision of an additional external wall (13*b*), which is spaced in relation to the adjacent opposite lateral wall (13*a*).

4. Ice mold, as in claim 1, characterized in that each anchoring means (35) is formed by at least one superficial discontinuity of the internal face of one of the opposite lateral wall (13*a*), additional external wall (13*b*) and bottom wall (14) of the receptacle (30).

5. Ice mold, as in claim 1, characterized in that each anchoring means (35) is defined by reducing the dimension of the contour of the upper opening of the receptacle (30) in relation to the contour of the bottom wall (14*a*) thereof.

6. Ice mold, as in claim 5, characterized in that the dimensional reduction of the contour of the upper opening of the receptacle (30) is obtained by the inclination of the additional external wall (13*b*) thereof.

7. Ice mold, as in claim 1, characterized in that each receptacle (30) has a bottom wall (14*a*) defined by a respective lateral projection of the bottom wall (14) of the cavity (11).

* * * * *